US007174660B2

(12) United States Patent
Sakai et al.

(10) Patent No.: US 7,174,660 B2
(45) Date of Patent: Feb. 13, 2007

(54) SNOW REMOVING MACHINE

(75) Inventors: Seishu Sakai, Wako (JP); Kiyomi Yanai, Wako (JP); Nobuo Yamazaki, Wako (JP)

(73) Assignee: Honda Motor Co., Ltd. (JP)

( * ) Notice: Subject to any disclaimer, the term of this patent is extended or adjusted under 35 U.S.C. 154(b) by 0 days.

(21) Appl. No.: 10/896,204

(22) Filed: Jul. 21, 2004

(65) Prior Publication Data

US 2005/0039352 A1 Feb. 24, 2005

(30) Foreign Application Priority Data

Aug. 20, 2003 (JP) ..... 2003-296827

(51) Int. Cl.
*E01H 5/09* (2006.01)

(52) U.S. Cl. ..... 37/260; 37/256; 198/640

(58) Field of Classification Search ..... 37/260, 37/261, 262, 237, 256; 198/638, 640, 642
See application file for complete search history.

(56) References Cited

U.S. PATENT DOCUMENTS 2,712,412 A * 7/1955 West ..... 406/99
2,944,308 A * 7/1960 Beech ..... 198/642
3,589,500 A * 6/1971 Hansen ..... 198/640
4,425,058 A * 1/1984 Sorensen et al. ..... 406/100
4,477,989 A 10/1984 Vachon
4,696,432 A * 9/1987 Russ et al. ..... 241/101.742
5,147,030 A * 9/1992 Buschbom ..... 198/642
5,190,140 A * 3/1993 Buschbom ..... 198/642
2002/0178622 A1 12/2002 Loegering et al.

FOREIGN PATENT DOCUMENTS

JP 03030417 2/1988

* cited by examiner

*Primary Examiner*—Thomas A Beach
(74) *Attorney, Agent, or Firm*—Adams & Wilks

(57) ABSTRACT

A snow removing machine has an auger for plowing and collecting snow, a rotatable blower for throwing snow collected by the auger, and a shooter for guiding the snow thrown by the blower so that the snow reaches a selected point. The blower has a central shaft part and blades extending radially outwardly from the shaft part. Each of the blades has one pair of laterally spaced guide walls projecting from a distal end portion thereof in a direction of rotation of the blower. The pair of guide walls for each of the blades extend divergently from each other towards a distal end of the blade.

12 Claims, 8 Drawing Sheets

SNOW REMOVING MACHINE

FIELD OF THE INVENTION

The present invention relates to a snow removing machine having an auger for plowing and collecting snow, a blower for throwing the collected snow, and a shooter for guiding the thrown snow such that the snow reaches a selected point.

BACKGROUND OF THE INVENTION

Snow removing machines of the type described are known as disclosed, for example, in Japanese Utility Model Publication No. HEI 3-30417.

As shown in FIG. 8 hereof, the disclosed snow removing machine includes a blower 150 having plural blades 151 (only one shown) extending radially outwardly from a drive shaft (not shown). The blade 151 has one pair of parallel spaced guide walls 153, 153 projecting from a distal end portion 152 of the blade 151 in a direction of rotation of the blower 150.

In operation, rotation of the blower 150 in a direction of an arrow causes the blade 151 to plow snow 155 within a blower housing 154 and carry the same on the distal end portion 152 thereof. When the distal end portion 152 of the blade 151 arrives at a snowthrown port 156 formed on an upper 20 part of the blower housing 154, the snow 155 is thrown upward from the distal end portion 152 into the snow-thrown port 156 under the action of a centrifugal force. The snow thus thrown by the blade 151 is guided by a shooter (not shown) so that it reaches a selected position.

As the blade 151 moves along an inner peripheral surface of the blower housing 154 in a direction towards the snow-thrown port 156, the snow 155 carried on the blade 151 is forced to move in a radial outward direction under the effect of centrifugal force and, hence, the snow is gradually stuffed into a space defined between the guide walls 153, 153. In this instance, since the guide walls 153, 153 of the blade 151 extend parallel with each other, there is produced a relatively large friction force acting between the snow and the guide walls 153, 153. The large friction force acts to resist or hinder movement of snow 155 when the snow 155 is thrown upwardly from the distal end portion 152 of the blade 151 towards the snow-thrown port 156. Additionally, the large friction force causes the snow 155 to break into plural small pieces as the snow is thrown from the blade. The plural small pieces of snow can be thrown only over an insufficient distance and hardly reach a desired point.

SUMMARY OF THE INVENTION

With the foregoing in view, an object of the present invention is to provide a snow removing machine having a snow blower which is capable of smoothly throwing snow over a sufficient distance in the form of a single snow block.

According to one aspect of the present invention, there is provided a snow removing machine comprising: an auger for plowing and collecting snow; a rotatable blower for throwing the collected snow; a shooter for guiding the thrown snow such that the snow reaches a selected point; the blower including: a central shaft part; and a plurality of blades extending radially outwardly from the shaft part, the blades each having one pair of laterally spaced guide walls projecting from a distal end portion thereof in a direction of rotation of the blower, the guide walls extending divergently from each other towards a distal end of the blade.

With this arrangement, since a friction resistance acting between the divergently arranged guide walls and the snow is small, the snow can smoothly move along the guide walls and be thrown from the blade a sufficient distance to a selected position while keeping the form of a single snow block.

Preferably, the blade includes a support member integral with the shaft part, and a blade body detachably connected to the support member and having the guide walls. This arrangement ensures that the blade body can be replaced with new one, when broken or damaged, without involving replacement of the whole blower.

In a preferred form of the present invention, the support member has a distal end portion inclined backward away from the blade body so as to define between the blade body and the backwardly inclined distal end portion of the support member a clearance for allowing the blade body to undergo elastic deformation within a range of the clearance when the blade body is subjected to a load. The elastic deformation of the blade body enlarges a gap between the blade body and an inner surface of a blower housing so that a foreign matter such as stone which has been trapped between the blade and the housing is allowed to escape through the gap thus enlarged.

Preferably, the distal end portion of the support member has a beveled part at one side thereof for allowing the blade body to further elastically deform to assume a twisted position in which the blade body twists itself about the beveled part of the distal end portion of the support member. With this twisting of the blade body, the gap between the blade body and the inner surface of the blower housing is further enlarged, allowing a foreign matter of larger size to escape from the blower housing through the further enlarged gap.

The blade body may have a positioning lug bent at right angles to a plane of the blade body for guiding engagement with an edge of the support member to position the blade body relative to the support member. The positioning lug precludes angular movement of the blade body relative to the support member and thus facilitates easy assembling of the blade body and the support member.

Preferably, each of the guide walls is inclined relative to a normal line to the shaft part at an angle between 3 and 7 degrees. Both guide walls may be inclined substantially at the same angle relative to the normal line.

BRIEF DESCRIPTION OF THE DRAWINGS

A certain preferred embodiment of the present invention will hereinafter be described in detail, by way of example only, with reference to the accompanying drawings, in which.

DETAILED DESCRIPTION OF THE PREFERRED EMBODIMENT

The terms "front", "rear", "left", and "right" are used with reference to a direction in which a snow removing machine of the present invention travels.

Figure 1:
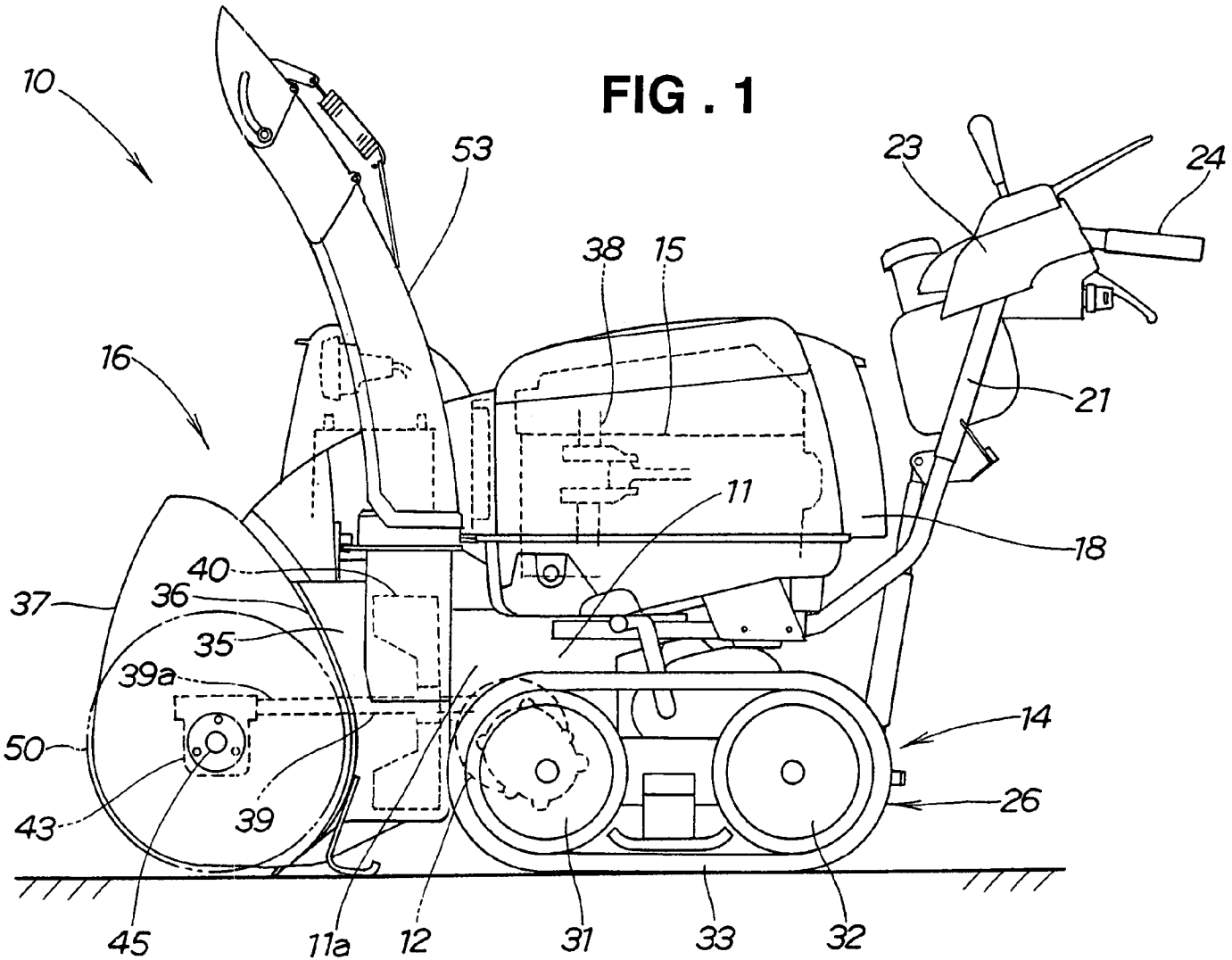
FIG. 1 is a side elevation view of a snow removing machine according to the present invention.

Referring to FIG. 1, a walk-behind, self-propelled snow removing machine 10 includes a transmission case 11 as a machine body, left and right electric motors (only left one is shown and designated at 12) attached to left and right sides of a lower part of the transmission case 11, a traveling apparatus 14 connected to the electric motors, an engine 15 attached to an upper part of the transmission case 11, a snow removing unit 16 attached to a front part of the transmission case 11 and driven by the engine 15, and left and right operational handlebars (only left one is shown and designated at 21) extending upwardly and rearward from the upper part of the transmission case 11. The snow removing machine 10 also includes a cover 18 covering a rear part of the snow removing unit 16 and the engine 15, and a control board 23 attached between the left and right operational handlebars. The left and right operational handlebars have left and right grips (only left one is shown and designated at 24), respectively. An operator manipulates the snow removing machine 10 while walking behind the control board 23 with the left and right grips grasped by operator's hands.

The traveling apparatus 14 includes a left traveling unit 26 disposed outside the left electric motor 12, and a right traveling unit (not shown) disposed outside the right electric motor. The right traveling unit has the same arrangement as the left traveling unit 26 and hence explanation of the right traveling part will be omitted.

The left traveling unit 26 includes a driving wheel 31 connected to the left electric motor 12, a driven wheel 32 disposed rearward of the driving wheel 31, and a crawler belt 33 extending around the driving wheel 31 and the driven wheel 32. The driving wheel 31 is driven by the electric motor 12 to move or travel the crawler belt 33 around the driving and driven wheels 31 and 32.

In operation, the snow-removing unit 16 is driven by the engine 15, and then the left and right electric motors are driven to rotate the left and right driving wheels to thereby cause the crawler belts to run or travel around the driving and driven wheels whereupon the snow removing machine 10 starts to travel while performing a snow-removing operation.

The snow removing unit 16 will be explained in detail hereinbelow. The snow removing unit 16 includes a blower housing 35 disposed on a front portion 11*a* of the transmission case 11, an auger housing 37 disposed on a front portion 36 of the blower housing 35, a blower 40 disposed within the blower housing 35, augers (only left one is shown and designated at 50) disposed in axial alignment within the auger housing 37, and a shooter 53 disposed on an upper part of the blower housing 35. A drive shaft 39 is connected to a crankshaft 38 of the engine 15. The drive shaft 39 extends forwardly from the engine 15 through the blower housing 35 into the auger housing 37. The blower 40 is mounted on the drive shaft 39. The drive shaft 39 has a distal end portion 39 connected to a power transmission, so-called an auger transmission 43, disposed at a transversely center within the auger housing 37. Left and right auger shafts (only left one is shown and designated at 45) extend leftward and rightward from the auger transmission 43, respectively. The left and right augers are mounted on the left and right auger shafts, respectively.

The drive shaft 39 is rotated by the engine 15 to thereby rotate the blower 40 as well as to rotate the left and right auger shafts via the auger transmission 43 to rotate the left and right augers.

When the snow removing machine 10 is propelled while rotating the augers and the blower 40, the left and right augers bite into and plow snow and then collect the same into the blower housing 35. The collected snow is thrown by the blower 40 through a snow-thrown port 88 (FIG. 5A), after which the snow is guided by the shooter 53 such that it is thrown out of the snow removing machine 10 to a desired point.

Figure 2:
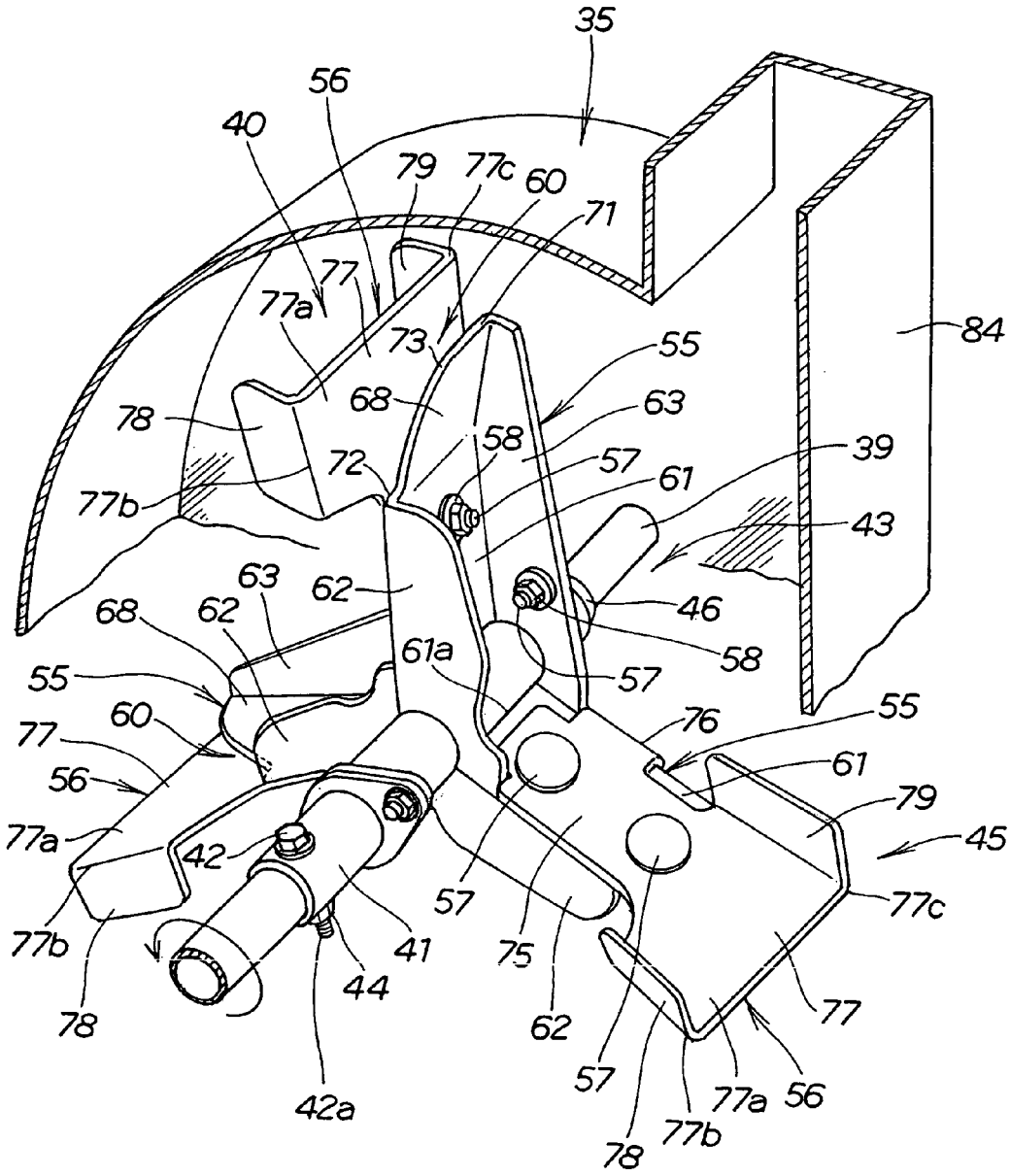
FIG. 2 is a perspective view of a blower of the snow removing machine.

Referring to FIG. 2, the blower 40 includes a central shaft part 43 and plural, that is, three blades 45 extending radially outwardly from the shaft part 43. The central shaft part 43 comprises a drive tube 46 through which the drive shaft 39 extends, and a cylindrical member 41 into which the drive shaft 46 extends. The cylindrical member 41, the drive tube 46, and the drive shaft 39 are fastened together by a bolt 42 and a nut 44. The bolt 42 extends diametrically across the cylindrical member 41, the drive shaft 46 and the drive shaft 39 fitted one over another. The bolt 42 has a threaded shank 42*a* projecting out of the cylindrical member 41 with which the nut 44 is threadedly engaged to lock the bolt 42 in position against removal from the central shaft part 43.

Each of the blades 45 comprises a support member 55 extending radially outwardly from the cylindrical member 41, and an elastically deformable blade body 56 detachably connected to the support member 55 by bolts 57 and nuts 58. The support members 55 of the three blades 45 are disposed about the cylindrical member 41 at regular intervals of 120 degrees. The blower 40 is rotatable within the blower housing 35.

The support member 55 has a generally U-shaped cross section and includes a front wall 62, a rear wall 63 and a sidewall 61 extending between the front and rear walls 62, 63. The sidewall 61 faces in a direction of rotation of the blower and serves as a retaining part for the mating blade body 56. The front and rear walls 62, 63 project from front and rear edges of the sidewall (retaining part) 61, respectively, in a backward direction opposite to the direction of rotation of the blower 40. The sidewall 61 has a proximal end 61*a* disposed along the cylindrical member 41. Each of the front and rear walls 62, 63 has a proximal end secured on an outer periphery of the cylindrical member 41. Thus, the support member 55 is integral with the cylindrical member 41.

The sidewall (retaining part) 61 of the support member 55 has a distal end portion 68 inclined backward relative to the direction end portion 68 inclined backward relative to the direction of rotation of the blower 40 for a purpose described latter. The backwardly inclined distal end portion 68 has a beveled part 73 at a front side thereof.

The blade body 56 includes an inner part 75 disposed closely to the shaft part 43 and an outer part 77 disposed remotely from the shaft part 43. The inner part 75 of the blade body 56 is detachably connected by the bolts 57, 57 and nuts 58, 58 to the retaining part (sidewall) 61 of the support member 55. The blade body 56 further includes a positioning lug 76 bent at right angles to 10 a plane of the inner part 75 and lying flat on the rear wall 63 of the support member 55 for positioning the blade body 56 relative to the support member 55 when they are connected together. The positioning lug 76 is secured by bolts 57, 57 and nuts 58, 58 to the rear wall 63. The thus secured positioning lug 76 serves also as an anti-rotation member that prevents the blade body 56 from 15 rotating about an axis of one bolt 58 when the other bolt 58 is broken. The outer part 77 of the blade body 56 is laterally enlarged so that a front portion 77 a projects forwardly of the distal end portion 68 of the support member 55. With the forwardly projecting front portion 77*a,* a maximum amount of snow that can be carried on the blade body 56 is increased by an amount 20 corresponding to a surface area of the front portion 77*a.*

The blade body 56 includes a pair of laterally spaced front and rear guide walls 78, 79 projecting from front and rear edges 77*b*, 77*c* of the outer part 77 in the direction of rotation of the blower 40. The front and rear guide walls 78, 79 extend divergently from each other towards a distal end of the blade body 56 for a reason explained later. The guide walls 78, 79 guide snow on the blade body 56, especially, on the outer part 77 towards the distal end of the blade body 56 when the blade body 56 throws the snow.

Because the blade body 56 is detachably connected to the support member 55 by the bolts 57, 57 and the nuts 58, 58, as discussed above, the blade body 56 can be readily replaced with another new one by mere detachment of the bolts 58, 58 and the nuts 58, 58 from the blade 45 when the blade body 56 undergoes plastic deformation or breaks.

Figure 3:
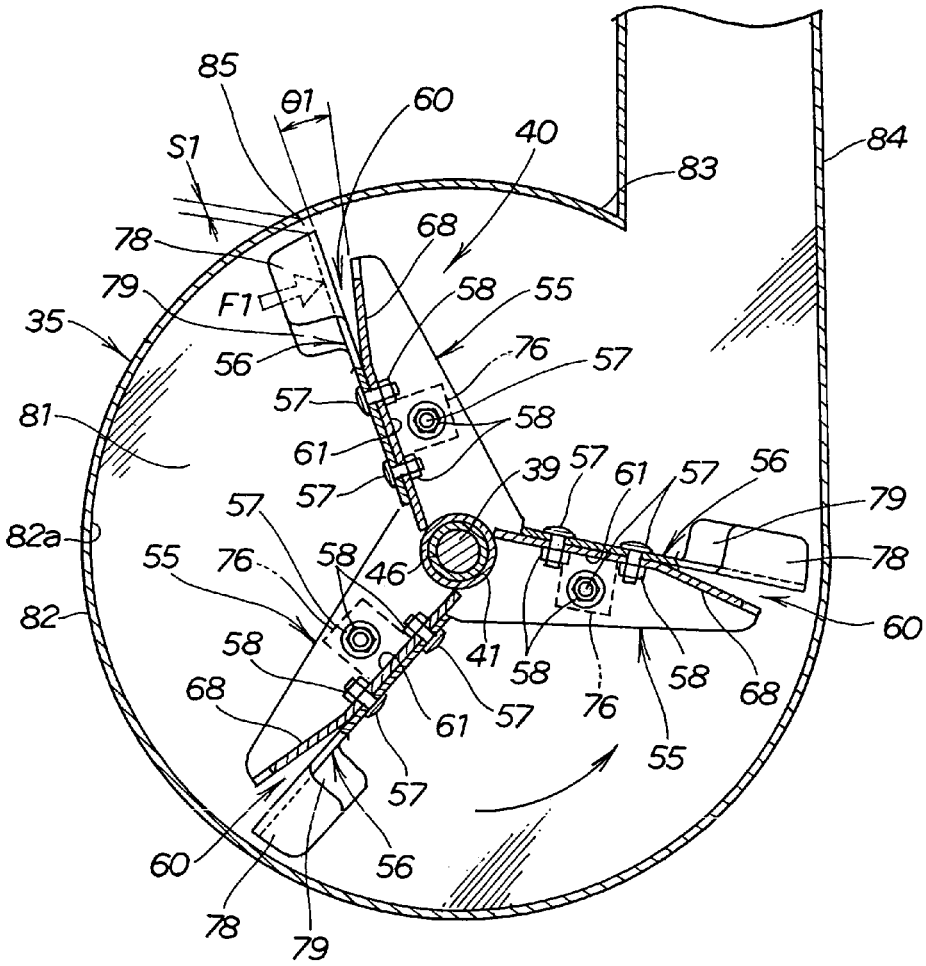
FIG. 3 is a vertical cross-sectional view of the blower.

Referring to FIG. 3, the blower housing 35 includes a circular rear wall 81, an arc-shaped peripheral wall 82 disposed along an outer periphery of the rear wall 81, and a duct portion 84 of quadrangular cross-section disposed at a left upper portion 83 of the peripheral wall 82. The shooter 53 (FIG. 1) is attached to the duct portion 84 of the blower housing 35.

The outer part 77 of the blade body 56 is spaced from an inner peripheral surface 82*a* of the blower housing 35 by a given interval S1 so as to define a gap 85 between the outer part 77 of the blade body 56 and the inner peripheral surface 82*a.*

The distal end portion 68 of the retaining part (sidewall) 61 of the support member 55 is inclined at an angle θ1 in the backward direction away from the outer part 77 of the blade body 56 so as to define a clearance 60 between the backwardly inclined distal end portion 68 of the support member 55 and the outer part 77 of the blade body 56 for allowing the outer part 77 to undergo elastic deformation within the range of the clearance 60. The angle θ1 is set to allow the outer part 77 of the blade body 56 to elastically deform within a limit of elastic deformation in the backward direction.

When the outer part 77 of the blade body 56 is subjected to a load F1 as indicated by a profiled arrow while the blower 40 is rotating as indicated by an arrow, the outer part 77 of the blade body 56 undergoes elastic deformation in the backward direction opposite to the direction of rotation of the blower 40 until it comes into abutment on the distal end portion 68 of the retaining part (sidewall) 61 of the support member 55. In this instance, the gap 85 between the outer part 77 of the blade body 56 and the inner peripheral surface 82*a* of the blower housing 35 is enlarged so that a foreign matter (not shown) which has entered the gap 85 can escape from the enlarged gap 85.

When the load F1 is removed from the outer part 77 of the blade body 56, the outer part 77 of the blade body 56 is allowed to return by its own resiliency to an original position as shown in FIG. 3.

The blade body 56 is preferably made from material of high elastic limit, for example, carbon tool steel (SK material specified by Japanese Industrial Standards) or carbon steel (S50C material specified by Japanese Industrial Standards).

Figure 4:
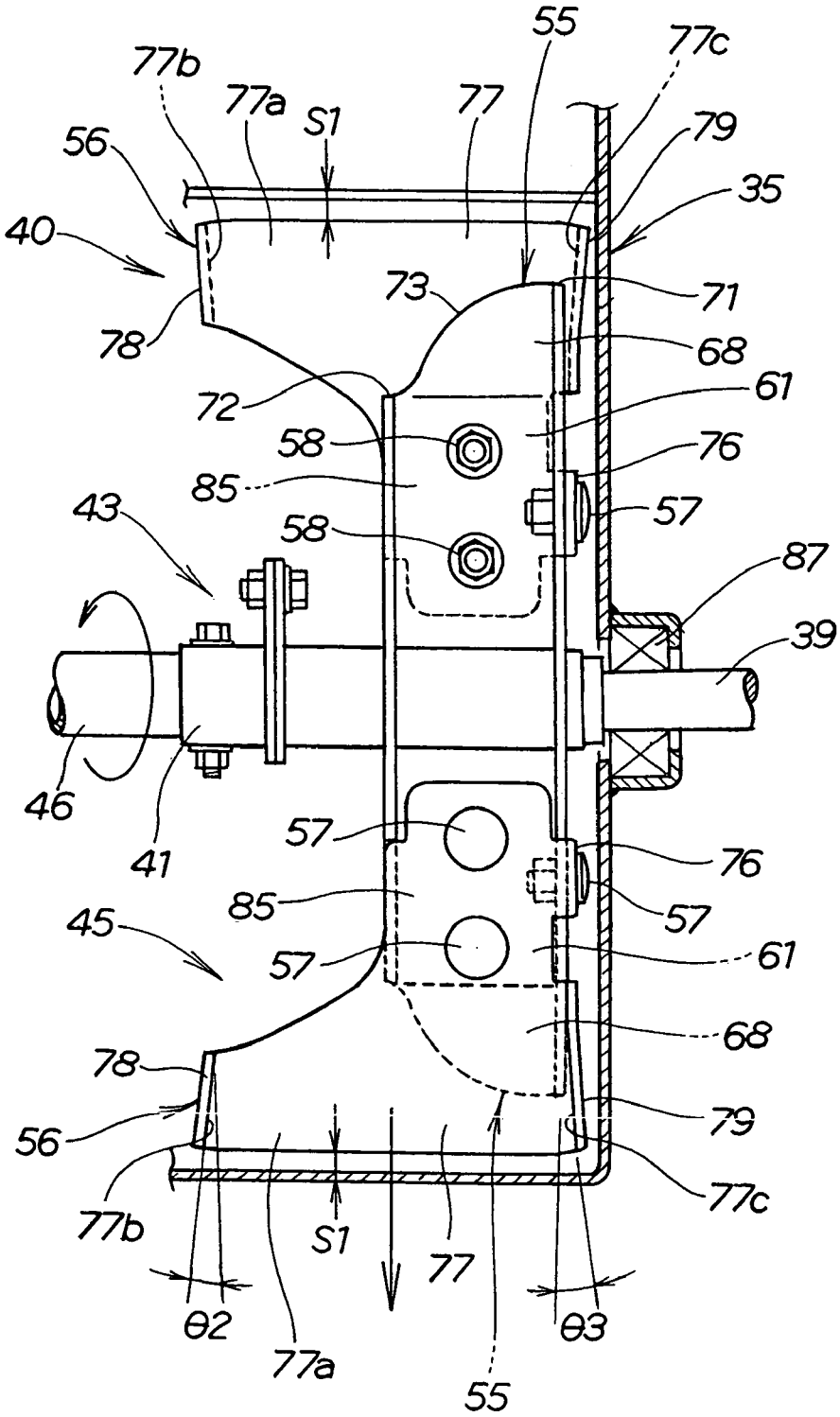
FIG. 4 is a side elevation view of the blower.

As shown in FIG. 4, the drive shaft 39 extending forward from the engine 15 (FIG. 1) through the blower housing 35 is rotationally supported by a bearing 87 of the blower housing 35. The blower 40 disposed within the blower housing 35 is mounted on the drive shaft 39.

The drive shaft 39 is rotated by the engine 15 to thereby rotate the blower 40 as shown by an arrow.

As described above, when subjected to the load F1 (FIG. 3), the outer part 77 including the guide walls 78, 79 of the blade body 56 is allowed to undergo elastic deformation in the backward direction until it comes into abutment on the distal end portion 68 of the retaining part 61 of the support member 55.

When the load F1 on the outer part 77 of the blade body 56 further continues, the forwardly projecting front portion 77*a* of the outer part 77 further yields or elastically deforms in the backward direction so that the outer part 77 assumes a backwardly twisted position about the beveled part 73 of the distal end portion 68 of the support member 55.

With this twisting of the outer part 77 including the front end portion 77*a*, the gap 85 between the outer part 77 of the blade body 56 and the inner peripheral surface 82*a* of the blower housing 35 is further enlarged, allowing a foreign member of larger size to escape from the gap 85.

As described above, the front guide wall 78 projects from the front edge 77*b* of the outer part 77 in the direction of rotation of the blower 40 while the rear guide wall 79 projects from the rear edge 77*c* of the outer part 77 in the direction of rotation of the blower 40.

The front and rear guide walls 78, 79 extend divergently from each other towards the distal end of the blade body 56. The front guide wall 78 is inclined at an angle θ2 relative to a normal line to the central shaft part 43. Similarly, the rear guide wall 79 is inclined at an angle θ3 relative to the normal line. The angles of inclination θ2, θ3 are preferably in the range of 3 to 7 degrees. If the angles of inclination θ2, θ3 are smaller than 3 degrees, smooth throwing of the snow from the blade without involving breakage can not be achieved. Alternatively, if the angles of inclination θ2, θ3 are greater than 7 degrees, the guide walls 78, 79 can not efficiently guide the snow to the extent that the snow thrown from the blade fly over a sufficiently long distance. The angles θ2, θ3 may be equal to each other, as in the illustrated embodiment.

Discussion will be made in relation to FIG. 5A to FIG. 7 as to why the front and rear guide walls 78, 79 are arranged to extend divergently from each other towards the distal end of the blade body 56.

Figure 5A:
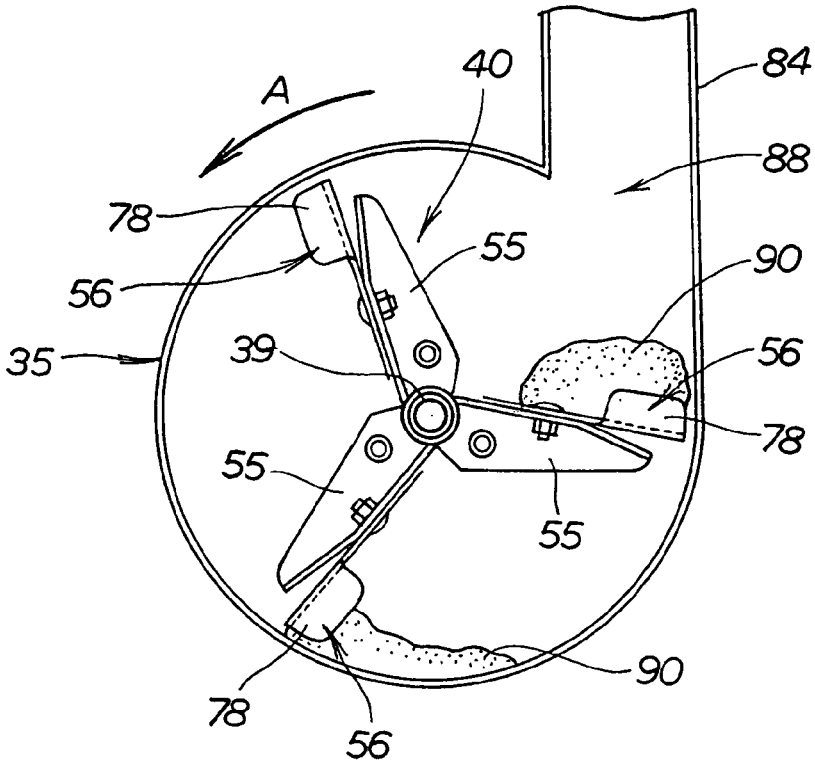
FIG. 5A is a diagrammatical view showing the condition in which one blade is about to throw the snow upwardly into a snow shooter during rotation of the blower.

FIG. 5A shows the rotating blower 40 with one of the three blades 45 of the blower 40 carrying snow thereon prior to throwing the snow.

The drive shaft 39 rotated by the engine 15 (FIG. 1) rotates the blower 40 in a direction of arrow A in synchronism with rotation of the left and right augers (FIG. 1). Rotation of the left and right augers plows and collects snow 90 centrally. The snow removing machine 10 travels forward and thereby the collected snow 90 is introduced into the blower housing 35. The snow 90 within the blower housing 35 is scooped up by the blade body 56 and then carried on the same. The blade body 56 with the snow 90 carried thereon moves along the inner peripheral surface of the blade housing 35 toward a position located below the snow-thrown port 88 of the duct portion 84 of the blower housing 35.

Figure 5B:
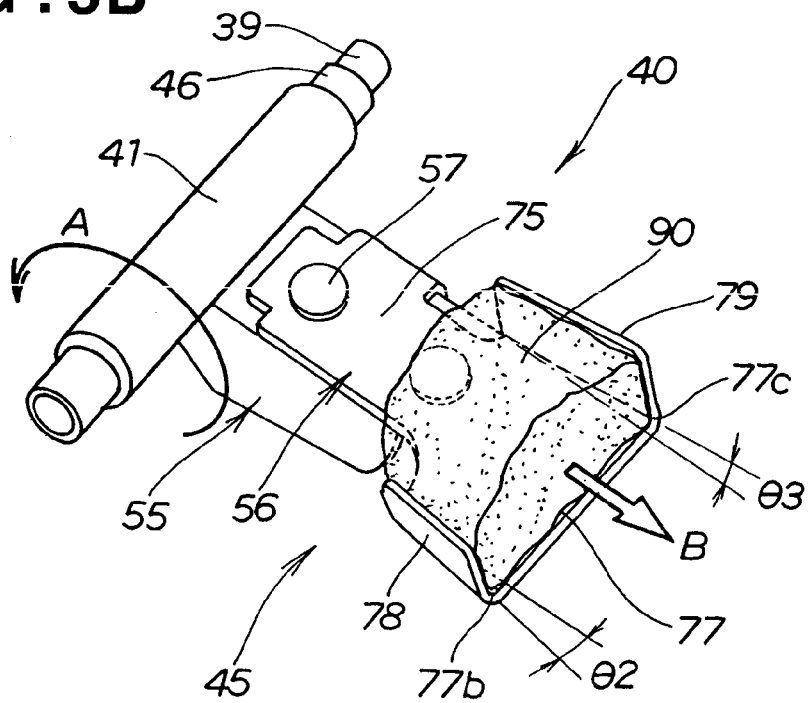
FIG. 5B is a perspective view illustrative of the operation of guide plates provided on each blade of the blower.

Subsequently, as the blade body 56 passes through the snow-thrown port 88, the snow 90 carried on the blade body 56 is thrown into the snow-thrown port 88 under the action of a centrifugal force. In this instance, since the guide walls 78, 79 provided on the blade body 56 are arranged to diverge from each other in a direction toward the distal end of the blade body 56, a friction force acting as a resistance between the snow 90 and the guide walls 78, 79 is small so that the snow 90 is smoothly thrown from the blade body 56 in a direction of arrow B, as shown in FIG. 5B. The small resistance between the snow 90 and the guide walls 78, 79 also enables the blade body 56 to throw the snow therefrom in the form of a single large snow block without breaking into small pieces.

Figure 6:
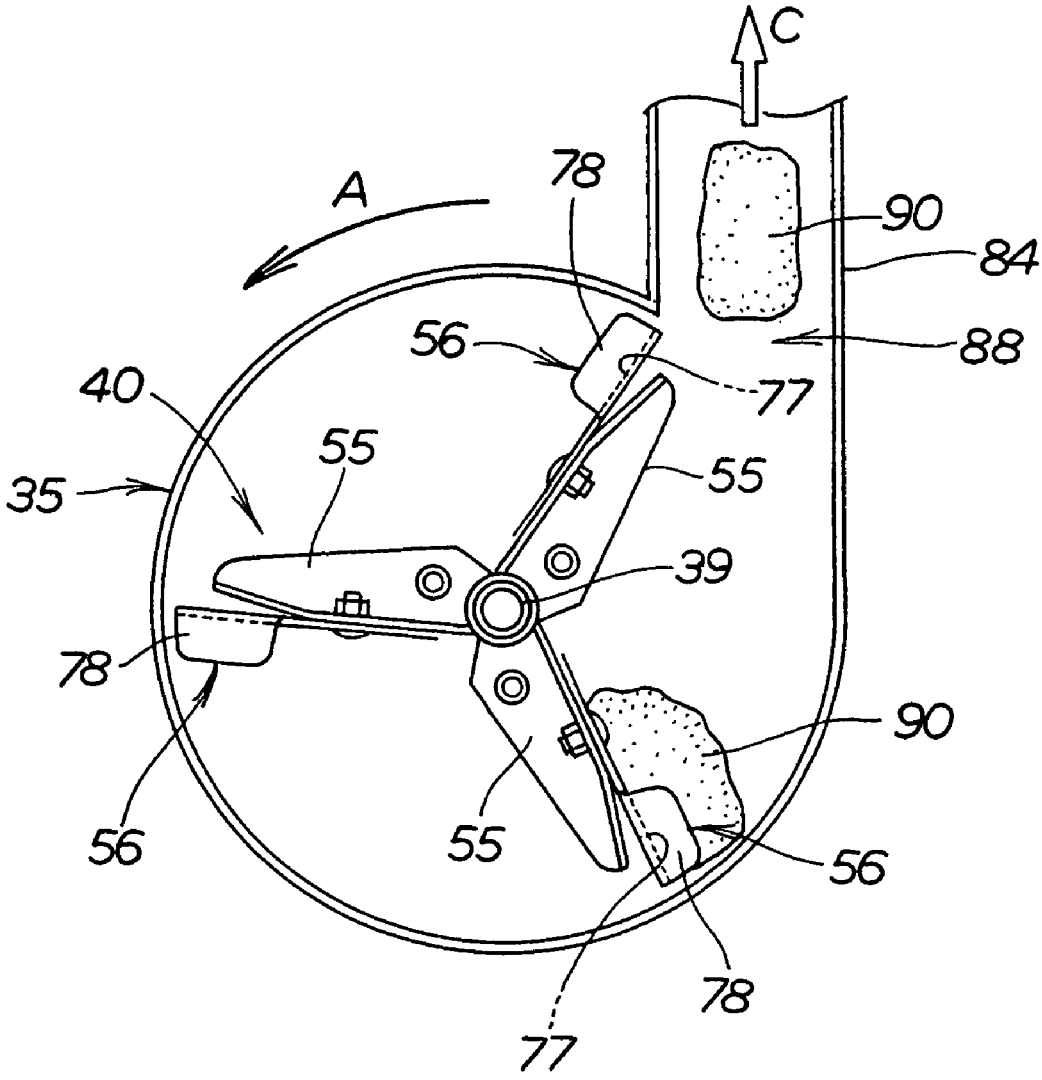
FIG. 6 is a view similar to FIG. 5A, but showing the condition in which the blade has finished snow-throwing operation.

FIG. 6 shows the rotating blower 40 with the blade 45 of FIG. 5B having finished throwing the snow 90.

The snow 90 thrown in the manner as discussed above with respect to FIG. 5B passes successively through the duct portion 84 and the shooter 53 (FIG. 1), as shown by an arrow C, out of the snow removing machine 10. Since the blade body 56 smoothly throws the snow 90 in the form of a single large snow block, the snow 90 can be thrown a sufficient distance from the snow removing machine 10 and reach a desired point.

Figure 7A:
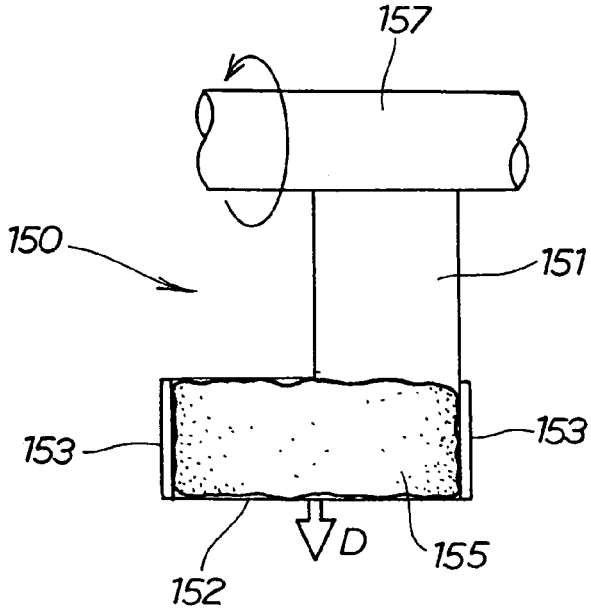
FIGS. 7A and 7B are diagrammatical views showing for comparative purposes the operations of a conventional blade with parallel spaced guide walls and an inventive blade with divergently arranged guide walls, respectively.
Figure 7B:
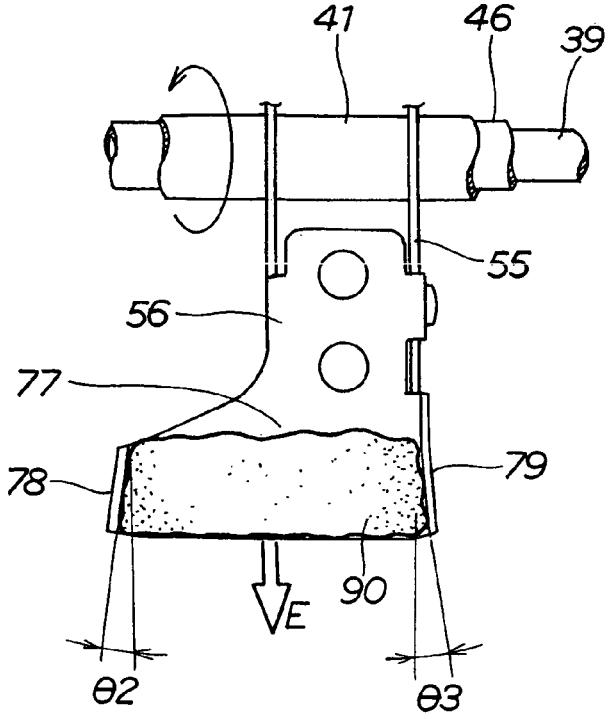

FIGS. 7A and 7B diagrammatically show, for comparative purposes, the operations of a conventional blade with parallel spaced guide walls (such as shown in Japanese Utility Model Publication No. HEI 3-30417 specified above) and an inventive blade with divergently arranged guide walls, respectively.

Figure 8:
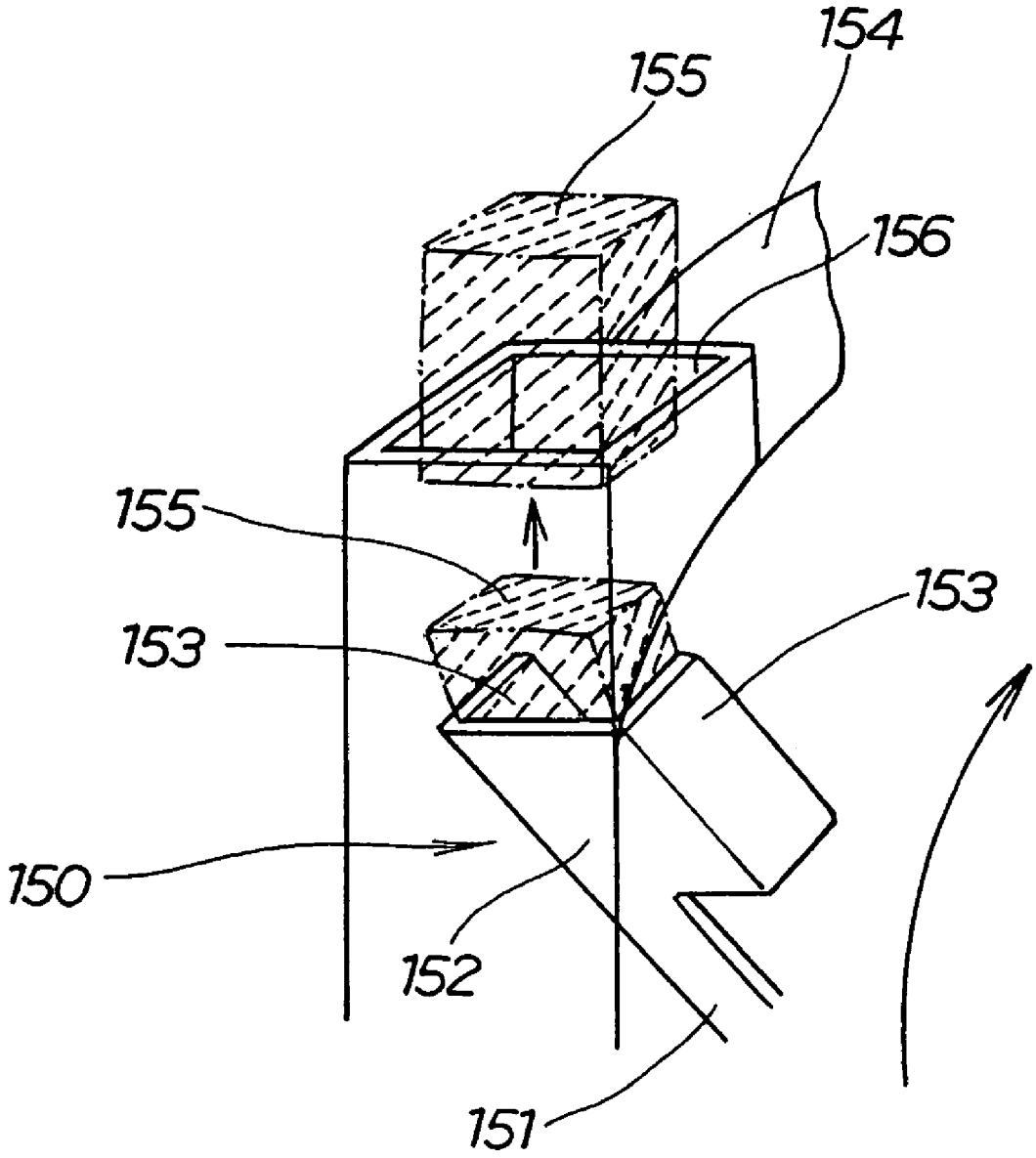
FIG . 8 (PRIOR ART)
FIG. 8 is a fragmentary perspective view showing a conventional blower.

In FIG. 7A, when a drive shaft 157 rotated by an engine (not shown) as shown by an arrow moves the blade 151 to a position located below the snow-thrown port 156 of the blower housing 154 (FIG. 8), snow 155 on the distal end portion 152 of the blade 151 is thrown in a direction of an arrow D towards the snow-thrown port 156.

The snow 155 thrown by the blade 151 passes through the snow-thrown port 156 and the shooter (not shown) out of a snow removing machine (not shown).

However, since the guide walls 153, 153 extend parallel with each other, a friction force acting as a resistance between the snow 155 and the guide walls 153, 153 is relatively large, which will hinder smooth throwing of the snow 155 from the blade 151. The large friction resistance also causes a problem that the snow 155, as it moves through a channel defined between the guide walls 153, 153, tends to break into small pieces. The small snow pieces thus broken cannot flow over a sufficient distance and are hard to reach a selected position.

In FIG. 7B, the drive shaft 39 is rotated by the engine 15 (FIG. 1) in a direction of an arrow to thereby move the blade body 56 to the position located below the snow-thrown port 88 of the blower housing 35 (FIG. 5A). Then, the snow 90 on the outer part 77 of the blade body 56 is thrown in a direction of an arrow E towards the snow-thrown port 88. The thrown snow 90 passes through the snow-thrown port 88 and the shooter 53 out of the snow removing machine 10.

Because the guide walls 78, 79 are arranged to extend divergently from each other towards the distal end of the blade body 56, the friction force acting as the resistance between the snow 90 and the guide walls 78, 79 is so small that the snow 90 can be readily released from the guide walls 78, 79 and smoothly thrown from the blade body 56. Also, with the small friction force between the snow 90 and the guide walls 78, 79, the snow 90 is difficult to break into small pieces. Therefore, the snow 90 can be thrown by the blade body 56 in the form of a single large snow block. The single large block of snow 90 can be thrown a sufficient distance from the snow removing machine 10 and reach a desired point.

It will be appreciated that configurations of the support member 55 and the blade body 56 are not limited to those illustrated, but may be modified without departing film the scope of the appended claims.

Obviously, various minor changes and modifications of the present invention are possible in the light of the above teaching. It is therefore to be understood that within the scope of the appended claims the invention may be practiced otherwise than as specifically described.

What is claimed is:

1. A snow removing machine comprising:

an auger for plowing and collecting snow;

a rotatable blower for throwing snow collected by the auger; and a shooter for guiding the snow thrown by the blower so that the snow reaches a selected point;

wherein the blower has a central shaft part and a plurality of blades extending radially outwardly from the shaft part, each of the blades having one pair of laterally spaced guide walls disposed on and projecting from a distal end portion thereof in a direction of rotation of the blower, the pair of guide walls for each of the blades extending divergently from each other towards a distal end of the blade, and for each of the blades each of the guide walls is inclined relative to a line normal to the shaft part and has one end disposed at the distal end of the blade.

2. A snow removing machine according to claim 1; wherein each of the blades comprises a support member integral with the shaft part, and a blade body detachably connected to the support member and having the guide walls.

3. A snow removing machine according to claim 2; wherein for each of the blades the support member has a distal end portion inclined rearwardly away from the blade body so as to define between the blade body and the rearwardly inclined distal end portion of the support member a clearance for allowing the blade body to undergo elastic deformation within a range of the clearance when the blade body is subjected to a load.

4. A snow removing machine according to claim 3; wherein for each of the blades the distal end portion of the support member has a beveled part at one side thereof for allowing the blade body to further elastically deform to assume a twisted position in which the blade body twists itself about the beveled part of the distal end portion of the support member when the blade body is subjected to a load.

5. A snow removing machine according to claim 2; wherein for each of the blades the blade body has a positioning lug bent at right angles to a plane of the blade body for guiding engagement with an edge of the support member to position the blade body relative to the support member.

6. A snow removing machine according to claim 1; wherein for each of the blades each of the guide walls is inclined relative to the line normal to the shaft part at an angle in the range of about 3 and 7 degrees.

7. A snow removing machine according to claim 6; wherein for each of the blades the guide walls are inclined at substantially the same angle relative to the normal line.

8. A snow removing machine comprising: an auger for plowing and collecting snow; and a rotatable blower for throwing snow collected by the auger, the blower having a rotatable shaft and a plurality of blades extending radially outwardly from the shaft, each of the blades comprising a support member integral with the shaft and a blade body detachably connected to the support member, the support member having a distal end portion inclined rearwardly away from the blade body so as to define between the blade body and the rearwardly inclined distal end portion a clearance for allowing the blade body to undergo elastic deformation within a range of the clearance when the blade body is subjected to a load during rotation of the blower; wherein for each of the blades of the blower the distal end portion of the support member has a beveled part at one side thereof for allowing the blade body to further elastically deform to assume a twisted position in which the blade body twists itself about the beveled part of the distal end portion of the support member when the blade body is subjected to a load.

9. A snow removing machine according to claim 8; wherein for each of the blades the blade body has a positioning lug bent at right angles to a plane of the blade body for guiding engagement with an edge of the support member to position the blade body relative to the support member.

10. A snow removing machine according to claim 8; wherein each of the blade bodies has one pair of laterally spaced guide walls projecting from the distal end portion thereof in a direction of rotation of the blower, the pair of guide walls for each of the blade bodies extending divergently from each other towards the distal end portion thereof.

11. A snow removing machine according to claim 10; wherein for each of the blade bodies each of the guide walls is inclined relative to a line normal to the shaft at an angle in the range of about 3 and 7 degrees.

12. A snow removing machine according to claim 11; wherein for each of the blade bodies the guide walls are inclined at substantially the same angle relative to the normal line.

* * * * *